US007855357B2

(12) United States Patent
Truche et al.

(10) Patent No.: US 7,855,357 B2
(45) Date of Patent: Dec. 21, 2010

(54) APPARATUS AND METHOD FOR ION CALIBRANT INTRODUCTION

(75) Inventors: Jean-Luc Truche, Los Altos, CA (US); Jian Bai, Sunnyvale, CA (US); Paul C Goodley, Cupertino, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 193 days.

(21) Appl. No.: 11/333,860

(22) Filed: Jan. 17, 2006

(65) Prior Publication Data

US 2007/0164231 A1 Jul. 19, 2007

(51) Int. Cl.
*H01J 49/10* (2006.01)

(52) U.S. Cl. ..... 250/288; 250/282; 250/423 R

(58) Field of Classification Search ..... 260/288; 250/288

See application file for complete search history.

(56) References Cited

U.S. PATENT DOCUMENTS 4,321,467 A * 3/1982 Buttrill, Jr. ..... 250/288
5,869,344 A * 2/1999 Linforth et al. ..... 436/173
6,646,253 B1 * 11/2003 Rohwer et al. ..... 250/288
6,825,462 B2 11/2004 Truche et al.
6,838,663 B2 * 1/2005 Coon et al. ..... 250/288
2003/0111600 A1 * 6/2003 Thomson et al. ..... 250/288
2007/0029473 A1 * 2/2007 Verentchikov ..... 250/281

OTHER PUBLICATIONS

Inventor(s): Jean-Luc Truche et al., Title: "Apparatus and Method for Ion Production Enhancement", Filing Date: Oct. 15, 2004, U.S. Appl. No. 10/966,278.

Inventor(s): Jean-Luc Truche et al., Title: "Apparatus and Method for Ion Production Enhancement", Filing Date: Oct. 15, 2004, U.S. Appl. No. 10/966,454.

* cited by examiner

*Primary Examiner*—Robert Kim
*Assistant Examiner*—Phillip A. Johnston

(57) ABSTRACT

The present invention relates to an apparatus and method for introducing calibrant ions into a conduit, ion source and/or mass spectrometry system.

9 Claims, 9 Drawing Sheets

APPARATUS AND METHOD FOR ION CALIBRANT INTRODUCTION

BACKGROUND

Most complex biological and chemical targets require the application of complementary multidimensional analysis tools and methods to compensate for target and matrix interferences. Correct analysis and separation is important to obtain reliable quantitative and qualitative information about a target. In this regard, mass spectrometers have been used extensively as detectors for various separation methods. However, until recently most spectral methods provided fragmentation patterns that were too complicated for quick and efficient analysis. The introduction of atmospheric pressure ionization (API) and matrix assisted laser desorption ionization (MALDI) has improved results substantially. For instance, these methods provide significantly reduced fragmentation patterns and high sensitivity for analysis of a wide variety of volatile and non-volatile compounds. The techniques have also had success on a broad based level of compounds including peptides, proteins, carbohydrates, oligosaccharides, natural products, cationic drugs, organoarsenic compounds, cyclic glucans, taxol, taxol derivatives, metalloporphyrins, porphyrins, kerogens, cyclic siloxanes, aromatic polyester dendrimers, oligodeoxynucleotides, polyaromatic hydrocarbons, polymers and lipids.

According to the MALDI method of ionization, the analyte and matrix is applied to a metal probe or target substrate. As the solvent evaporates, the analyte and matrix co-precipitate out of solution to form a solid solution of the analyte in the matrix on the target substrate. The co-precipitate is then irradiated with a short laser pulse inducing the accumulation of a large amount of energy in the co-precipitate through electronic excitation or molecular vibration of the matrix molecules. The matrix dissipates the energy by desorption, carrying along the analyte into the gaseous phase. During this desorption process, ions are formed by charge transfer between the photo-excited matrix and analyte.

Conventionally, the MALDI technique of ionization is performed using a time-of-flight analyzer, although other mass analyzers such as an ion trap, an ion cyclotron resonance mass spectrometer and quadrupole time-of-flight are also used. These analyzers, however, must operate under high vacuum, which among other things may limit the target throughput, reduce resolution, capture efficiency, and make testing targets more difficult and expensive to perform.

To overcome the above mentioned disadvantages in MALDI, a technique referred to as AP-MALDI has been developed. This technique employs the MALDI technique of ionization, but at atmospheric pressure. The MALDI and the AP-MALDI ionization techniques have much in common. For instance, both techniques are based on the process of pulsed laser beam desorption/ionization of a solid-state target material resulting in production of gas phase analyte molecular ions. However, the AP-MALDI ionization technique does not rely on a pressure differential between the ionization chamber and the mass spectrometer to direct the flow of ions into the inlet orifice of the mass spectrometer.

AP-MALDI can provide detection of a molecular mass up to $10^6$ Da from a target size in the attamole range. In addition, as large groups of proteins, peptides or other compounds are being processed and analyzed by these instruments, levels of sensitivity become increasingly important. Various structural and instrument changes have been made to MALDI mass spectrometers in an effort to improve sensitivity. Additions of parts and components, however, provides for increased instrument cost. In addition, attempts have been made to improve sensitivity by altering the analyte matrix mixed with the target. These additions and changes, however, have provided limited improvements in sensitivity with added cost. More recently, the qualitative and quantitative effects of heat on performance of AP-MALDI has been studied and assessed. In particular, it is believed that the performance of an unheated (room temperature) AP-MALDI source is quite poor due to the large and varying clusters produced in the analyte ions. These large clusters are formed and stabilized by collisions at atmospheric pressure. The results of different AP-MALDI matrixes to different levels of heat have been studied. In particular, studies have focused on heating the transfer capillary near the source. These studies show some limited improvement in overall instrument sensitivity. More recently a number of improvements have been made by introducing heated gas into the ionization region. However, this has caused some problems related to mass accuracy. For instance, the mass of ions generated by the MALDI process need to be accurately determined in order to provide meaningful information to be used by subsequent database searching algorithms.

The typical mass accuracy requirements are in low parts per million. Such calibration of the mass analyzers is either done with an external reference standard or an internal reference standard. When and external reference standard is used, a calibration sample is run prior to the analysis of the sample of interest. Any drift in the mass axis calibration, between the time when the calibration sample is run and the sample of interest is run, results in inaccuracy of the mass assigned to the sample of interest. Such problem is alleviated when the calibration sample is co-mixed with the sample of interest, as both samples are analyzed simultaneously. Unfortunately, such mixing of analytical sample and the calibration sample often result in a "suppression effect" where preferential ionization of the calibration sample affects ("suppress") the abundance of the ions of the sample of interest. To alleviate this problem, the concentration of the reference standard has to be precisely established for a given concentration of a given analytical sample, which is impractical when the concentration and the nature of the analytical sample is known.

Thus, there is a need to improve the apparatus and method for introduction of calibrant ions into conduits, ion sources and mass spectrometry systems.

SUMMARY OF THE INVENTION

The present invention relates to an apparatus and method for introducing calibration ions into a conduit, ion source, mass spectrometry system or similar type device.

The invention provides a mass spectrometry system for introducing calibrant ions into an ionization region, comprising an ion source comprising an ionization device for producing ions in an ionization region, a collecting conduit downstream from the ionization device for collecting ions, a conduit for introducing calibrants and heated gas into the ionization region, and a discharge electrode adjacent to the conduit for creating ionization of calibrants within the heated gas; and a detector downstream from the ion source for detecting ions.

The invention provides an ion source, comprising an ionization device for producing ions in an ionization region, a collecting conduit downstream from the ionization device for collecting ions, a conduit for introducing calibrants and heated gas into the ionization region; and a discharge electrode adjacent to the conduit for creating ionization of calibrants within the heated gas.

The invention also provides a method of generating calibration ions in a heated gas for introduction into sample ions, comprising providing a calibrant in a heated gas, ionizing the calibrant in the heated gas using an electrode to generate calibration ions, introducing the calibration ions and heated gas into the sample ions.

BRIEF DESCRIPTION OF THE FIGURES

The invention is described in detail below with reference to the following figures.

Figure 7A:
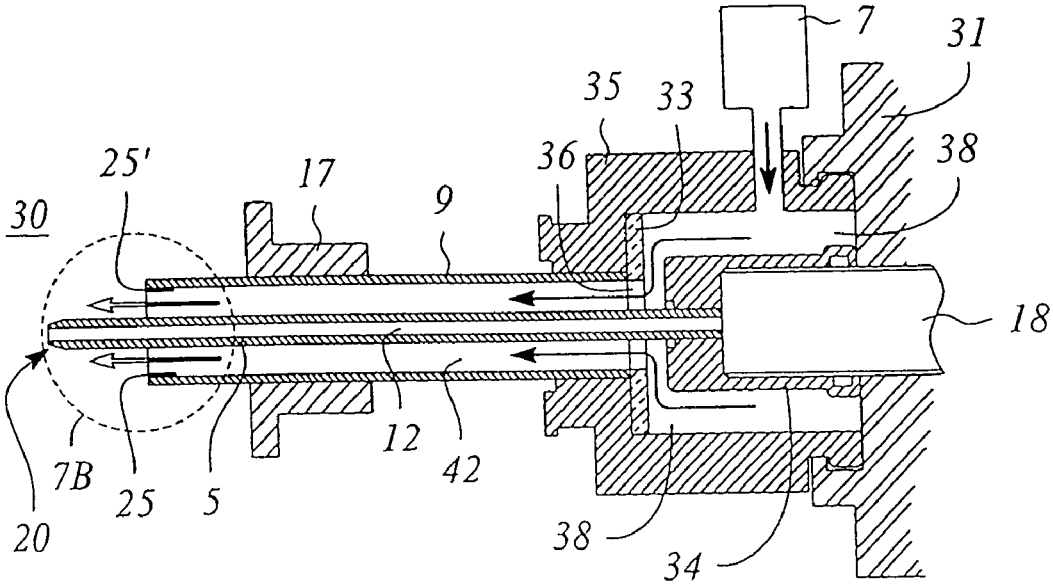
FIG. 7A shows the method of the present invention.

FIB. 7B shows an enlarged portion of FIG. 7A.

Figure 8A:
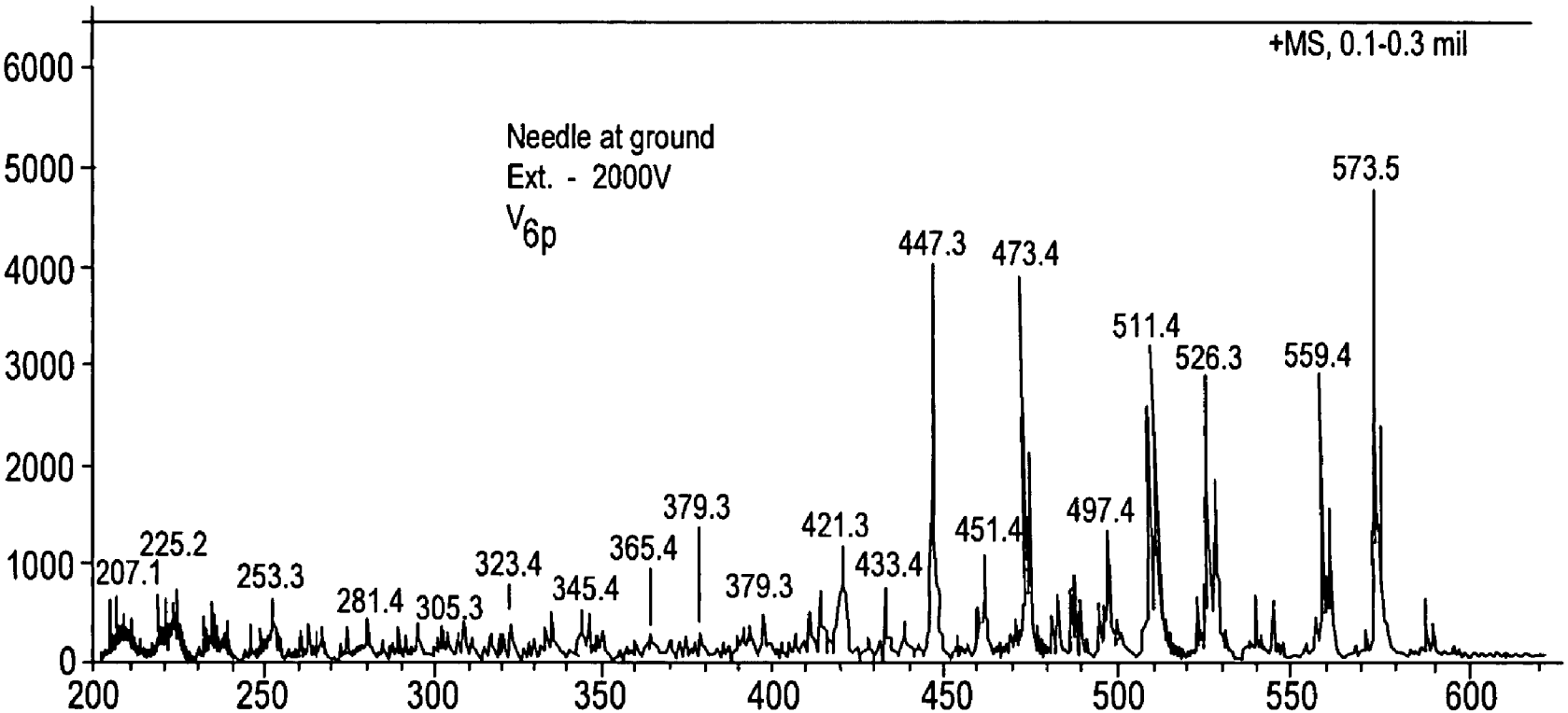

FIG. 8A shows a resulting spectrum without the application of the present invention.

Figure 8B:
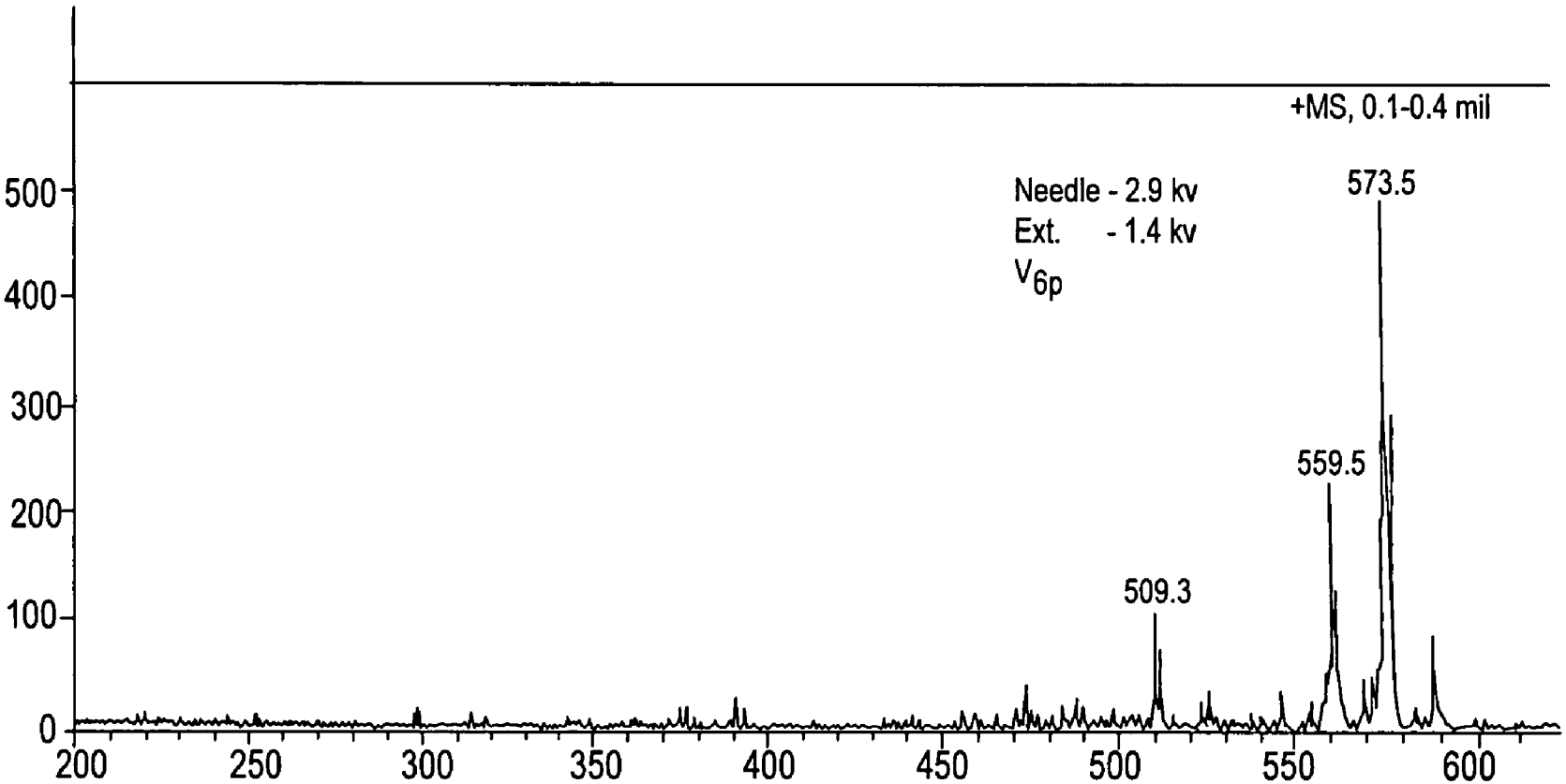

FIG. 8B shows a resulting spectrum with the application of the present invention.

DETAILED DESCRIPTION OF THE INVENTION

Before describing the invention in detail, it must be noted that, as used in this specification and the appended claims, the singular forms "a," "an," and "the" include plural referents unless the context clearly dictates otherwise. Thus, for example, reference to "a conduit" includes more than one "conduit". Reference to a "matrix" includes more than one "matrix" or a mixture of "matrixes". In describing and claiming the present invention, the following terminology will be used in accordance with the definitions set out below.

The term "adjacent" means, near, next to or adjoining. Something adjacent may also be in contact with another component, surround the other component, be spaced from the other component or contain a portion of the other component. For instance, a capillary that is adjacent to a conduit may be spaced next to the conduit, may contact the conduit, may surround or be surrounded by the conduit, may contain the conduit or be contained by the conduit, may adjoin the conduit or may be near the conduit.

The term "conduit" or "heated conduit" refers to any sleeve, transport device, capillary, dispenser, nozzle, hose, pipe, plate, pipette, port, connector, tube, coupling, container, housing, structure or apparatus that may be used to direct a heated gas or gas flow toward a defined region in space such as an ionization region. In particular, the "conduit" may be designed to enclose a capillary or portion of a capillary that receives analyte ions from an ion source. The term should be interpreted broadly, however, to also include any device, or apparatus that may be oriented toward the ionization region and which can provide a heated gas flow toward or into ions in the gas phase and/or in the ionization region. For instance, the term could also include a concave or convex plate with an aperture that directs a gas flow toward the ionization region.

The terms "collection capillary" or "collecting capillary", refer to any sleeve, transport device, capillary, dispenser, nozzle, hose, pipe, plate, pipette, port, connector, tube, coupling, container, housing, structure or apparatus that may be used to collect ions.

The term "discharge electrode" refers to any electrode that may be employed to ionize calibrants into calibrant ions. Various discharge electrodes are already well known in the art that are capable of accomplishing these functions.

The term "enhance" refers to any external physical stimulus such as heat, energy, light, or temperature change, etc. that makes a substance more easily characterized or identified. For example, a heated gas may be applied to "enhance" ions. The ions increase their kinetic energy, potentials or motions and are declustered or vaporized. Ions in this state are more easily detected by a mass analyzer. It should be noted that when the ions are "enhanced", the number of ions detected is enhanced since a higher number of analyte ions are sampled through a collecting capillary and carried to a mass analyzer or detector.

The term "ionization device" refers to any device used in the creation of ions. For instance an ionization device may comprise and not be limited to atmospheric pressure ionization devices (APPI), atmospheric pressure chemical ionization (APCI), electrospray (ESI), matrix assisted laser desorption ionization (MALDI), atmospheric pressure matrix assisted laser desorption ionization (AP-MALDI), infrared ionization, ultraviolet light (UV ionization) and others known in the art.

The term "ion source" or "source" refers to any source that produces analyte ions. Ion sources may include other sources besides AP-MALDI ion sources such as electron impact (herein after referred to as EI), chemical ionization (CI) and other ion sources known in the art. The term "ion source" refers to the laser, target substrate, and target to be ionized on the target substrate. The target substrate in AP-MALDI may include a grid for target deposition. Spacing between targets on such grids is around 1-10 mm. Approximately 0.5 to 2 microliters is deposited on each site on the grid.

The term "ionization region" refers to the area between the ion source and the collecting conduit. In particular, the term refers to the analyte ions produced by the ion source that reside in that region and which have not yet been channeled into the collecting conduit. This term should be interpreted broadly to include ions in, on, about or around the target support as well as ions in the heated gas phase above and around the target support and collecting conduit. The ionization region in AP MALDI is around 1-5 mm in distance from the ion source (target substrate) to a collecting conduit (or a volume of 1-5 $mm^3$). The distance from the target substrate to the conduit is important to allow ample gas to flow from the conduit toward the target and target substrate. For instance, if the conduit is too close to the target or target substrate, then arcing takes place when voltage is applied. If the distance is too far, then there is no efficient ion collection.

The terms "matrix based", or "matrix based ion source" refers to an ion source or mass spectrometer that does not require the use of a drying gas, curtain gas, or desolvation step. For instance, some systems require the use of such gases to remove solvent or cosolvent that is mixed with the analyte. These systems often use volatile liquids to help form smaller droplets. The above term applies to both nonvolatile liquids and solid materials in which the sample is dissolved. The term includes the use of a cosolvent. Cosolvents may be volatile or nonvolatile, but must not render the final matrix material capable of evaporating in vacuum. Such materials would include, and not be limited to m-nitrobenzyl alcohol (NBA), glycerol, triethanolamine (TEA), 2,4-dipentylphenol, 1,5-dithiothrietol/dierythritol (magic bullet), 2-nitrophenyl octyl ether (NPOE), thioglycerol, nicotinic acid, cinnamic acid, 2,5-dihydroxy benzoic acid (DHB), 3,5-dimethoxy-4-hydroxycinnamic acid (sinpinic acid), α-cyano-4-hydroxycinnamic acid (CCA), 3-methoxy-4-hydroxycinnamic acid (ferulic acid), ), monothioglycerol, carbowax, 2-(4-hydroxyphenylazo)benzoic acid (HABA), 3,4-dihydroxycinnamic acid (caffeic acid), 2-amino-4-methyl-5-nitropyridine with their cosolvents and derivatives.

In particular the term refers to MALDI, AP-MALDI, fast atom/ion bombardment (FAB) and other similar systems that do not require a volatile solvent and may be operated above, at, and below atmospheric pressure.

The term "gas flow", "gas", or "directed gas" refers to any gas that is directed in a defined direction in a mass spectrometry system. The term should be construed broadly to include monatomic, diatomic, triatomic and polyatomic molecules that can be passed or blown through a conduit. The term should also be construed broadly to include mixtures, impure mixtures, or contaminants. The term includes both inert and non-inert matter. Common gases used with the present invention could include and not be limited to ammonia, carbon dioxide, helium, fluorine, argon, xenon, nitrogen, air etc.

The term "gas source" refers to any apparatus, machine, conduit, or device that produces a desired gas or gas flow. Gas sources often produce regulated gas flow, but this is not required.

The term "detector" refers to any device, apparatus, machine, component, or system that can detect an ion. Detectors may or may not include hardware and software. In a mass spectrometer the common detector includes and/or is coupled to a mass analyzer.

The invention is described with reference to the figures. The figures are not to scale, and in particular, certain dimensions may be exaggerated for clarity of presentation.

Figure 1:
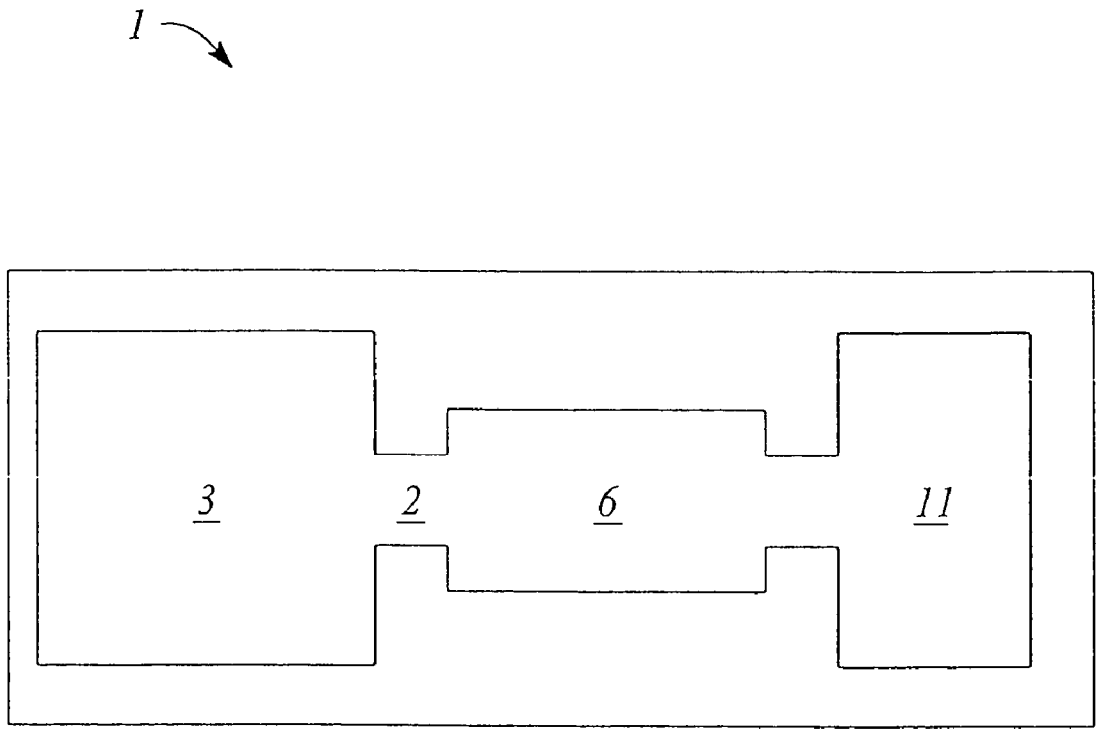
FIG. 1 shows general block diagram of a mass spectrometry system.

FIG. 1 shows a general block diagram of a mass spectrometry system. The block diagram is not to scale and is drawn in a general format because the present invention may be used with a variety of different types of mass spectrometers. A mass spectrometry system 1 of the present invention comprises an ion source 3, an ion enhancement system 2, an ion transport system 6 and a detector 11. The ion enhancement system 2 may be interposed between the ion source 3 and the ion detector 11 or may comprise part of the ion source 3 and/or part of the ion transport system 6.

The ion source 3 may be located in a number of positions or locations. In addition, a variety of ion sources may be used with the present invention. For instance, electrospray ionization (EI), chemical ionization (CI), atmospheric pressure photoionization (APPI), atmospheric pressure chemical ionization (APCI), or other ion sources well known in the art may be used with the present invention.

The ion enhancement system 2 may comprise a conduit 9 and a gas source 7. Further details of the ion enhancement system 2 are provided in FIGS. 2-3. The ion enhancement system 2 should not be interpreted to be limited to just these two configurations or embodiments. Other systems or apparatus for providing or creating heated gas flow may also be employed.

Figure 2:
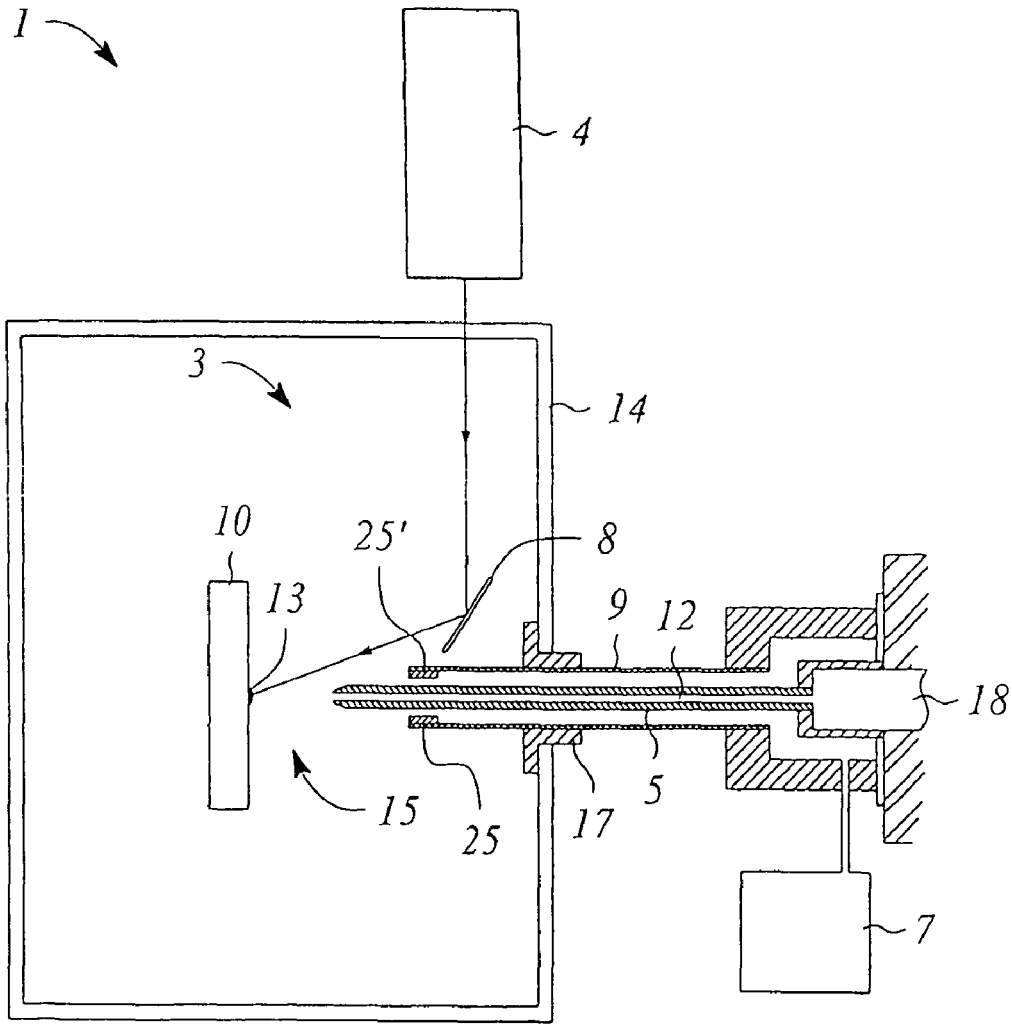
FIG. 2 shows a first embodiment of the present invention.
Figure 3:
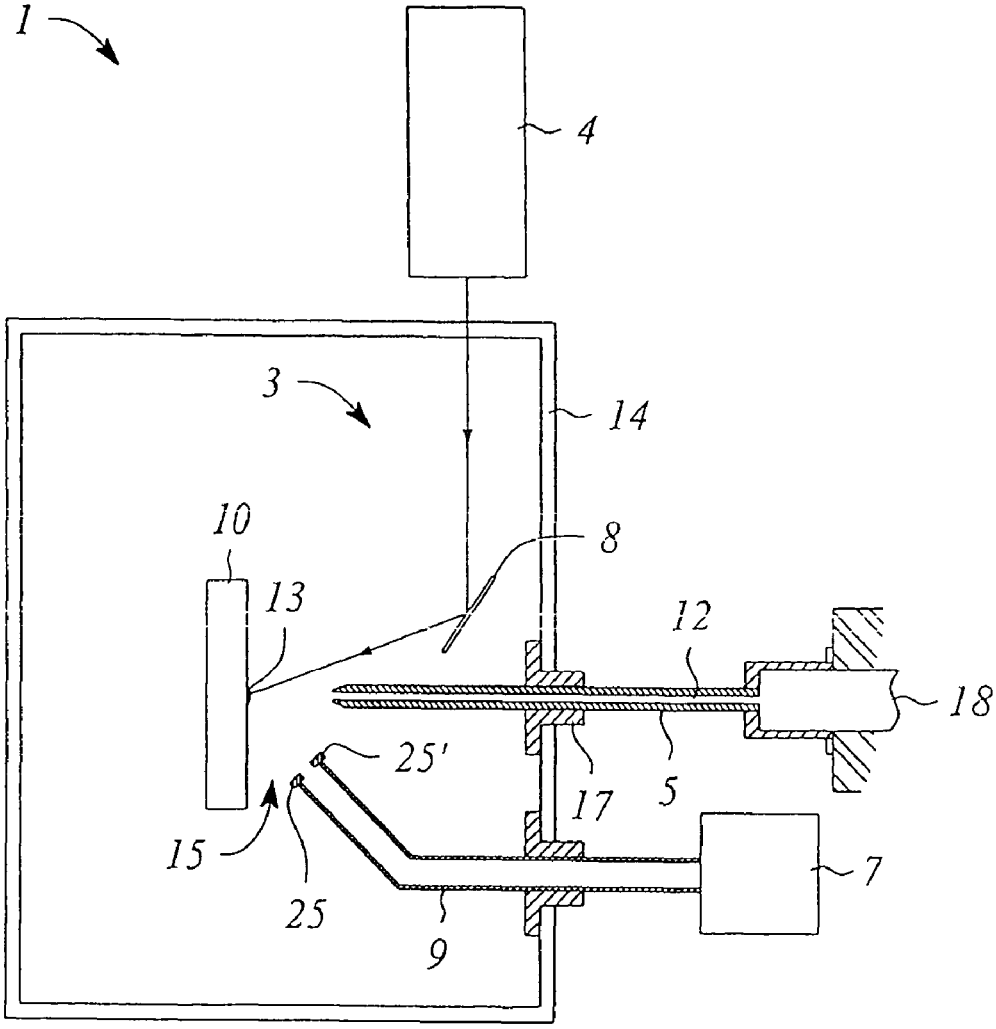
FIG. 3 shows a second embodiment of the present invention.

The ion transport system 6 is adjacent to the ion enhancement system 2 and may comprise a collecting capillary 5 or any ion optics, conduits or devices that may transport analyte ions and that are well known in the art (See FIGS. 2-3). Ion transport system 6 may comprise one or more of these collecting capillaries 5, ion optics or similar type devices. The devices and ion transport system 6 may be configured in any number of arrangements or orientations to move ions from one position to the next.

Detector 11 is positioned downstream from the ion transport system 6 (shown only in FIG. 1). The detector 11 may comprise any number of detectors well known in the art. For instance, such detectors may comprise and not be limited to a time of flight (TOF) or quick time of flight (Q-TOF) detectors. Other detectors known in the art may be employed with the present invention.

FIG. 2 shows a cross-sectional view of a first embodiment of the invention. The figure shows the present invention applied to an AP-MALDI mass spectrometry system. For simplicity, the figure shows the invention with a source housing 14. The use of the source housing 14 to enclose the ion source and system is optional. Certain parts, components and systems may or may not be under vacuum. These techniques and structures are well known in the art.

The ion source 3 comprises a laser 4, a deflector 8 and a target support 10. A target 13 is applied to the target support 10 in a matrix material. Various matrix materials are known and used in the art. The laser 4 provides a laser beam that is deflected by the deflector 8 toward the target 13. The target 13 is then ionized and the analyte ions are released as an ion plume into an ionization region 15. The ionization region 15 is located between the ion source 3 and the collecting capillary 5. The ionization region 15 comprises the space and area located in the area between the ion source 3 and the collecting capillary 5. This region receives the ions produced by ionizing the sample that are vaporized into a gas phase. This region can be adjusted in size and shape depending upon how the ion source 3 is arranged relative to the collecting capillary 5. Most importantly, located in this region are the analyte ions produced by ionization of the target 13.

The collecting capillary 5 is located downstream from the ion source 3 and may comprise a variety of material and designs that are well known in the art. The collecting capillary 5 is designed to receive and collect analyte ions produced from the ion source 3 that are discharged as an ion plume into the ionization region 15. The collecting capillary 5 may be employed in conjunction with a main capillary 18. A coupling 23 may be employed to join them together (See FIG. 4). The collecting capillary 5 may be supported in place by an optional insulator 17 (See FIG. 2). Other structures and devices well known in the art may be used to support the collecting capillary 5.

Important to the invention is the conduit 9. The conduit 9 provides a flow of heated gas toward the ions in the ionization region 15. The heated gas interacts with the analyte ions in the ionization region 15 to enhance the analyte ions and allow them to be more easily detected by the detector 11 (not shown in FIG. 2). The term "enhance" refers to any external physical stimulus such as heat, energy, light, or temperature change, etc. that makes a substance more easily characterized or identified. For example, a heated gas may be applied to "enhance" ions. The ions increase their kinetic energy, potentials or motions and are declustered or vaporized. Ions in this state are more easily detected by a mass analyzer. It should be noted that when the ions are "enhanced", the number of ions detected is enhanced since a higher number of analyte ions are sampled through a collecting capillary and carried to a mass analyzer or detector. These ions include the ions that exist in the heated gas phase.

The conduit 9 may comprise a variety of materials and devices well known in the art. For instance, the conduit 9 may comprise a sleeve, transport device, dispenser, nozzle, hose, pipe, pipette, port, connector, tube, coupling, container, housing, structure or apparatus that is used to direct a heated gas or gas flow toward a defined region in space or location such as the ionization region 15. It is important to the invention that conduit 9 be positioned sufficiently close to the target 13 and the target support 10 so that a sufficient amount of heated gas can be applied to the ions in the ionization region 15.

The gas source 7 provides the heated gas to the conduit 9. The gas source 7 may comprise any number of devices to provide heated gas. Gas sources are well known in the art and are described elsewhere. The gas source 7 may be a separate component as shown in FIGS. 2-3 or may be integrated with a coupling 23 (shown in FIG. 4) that operatively joins the collecting capillary 5, the conduit 9 and the main capillary 18. The gas source 7, may provide a number of gases to the conduit 9. For instance, gases such as nitrogen, argon, xenon, carbon dioxide, air, helium etc. may be used with the present invention. The gas need not be inert and should be capable of carrying a sufficient quantum of energy or heat. Other gases well known in the art that contain these characteristic properties may also be used with the present invention.

Important to the invention is the application of one or more discharge electrodes 25 and/or 25' adjacent to conduit 9 (See FIGS. 2-7). This electrode allows for the ionization of trace calibrants introduced into the gas source 7 or conduit 9. The discharge electrodes 25 and/or 25' may typically be in the form of a glow discharge electrode. One or more electrodes may be employed with the present invention. The invention should not be interpreted to be limited to the displayed embodiments. Other similar type electrodes known in the art may also be employed. By providing for ionization of the trace calibrants the discharge electrode allows for introduction of the calibrants at a similar time to creation of the analyte ions. The glow discharge electrode operates by creating an electric field that causes the calibrant to break down into respective ions. The calibrant ions are then mixed with the analyte ions by way of the heated gas. The electrode is important to this process. The actual location and point of introduction or gas used may vary.

FIG. 3 shows a cross sectional view of a second embodiment of the present invention. The conduit 9 may be oriented in any number of positions to direct gas toward the ionization region 15. FIG. 3 in particular shows the conduit 9 in detached mode from the collecting capillary 5. It is important to the invention that the conduit 9 be capable of directing a sufficient flow of heated gas to provide enhancement to the analyte ions located in the ionization region 15. The conduit 9 can be positioned from around 1-5 mm in distance from the target 13 or the target support 10. The heated gas applied to the target 13 and the target support 10 should be in the temperature range of about 60-150 degrees Celsius. The gas flow rate should be approximately 2-15 L/minute.

Figure 4:
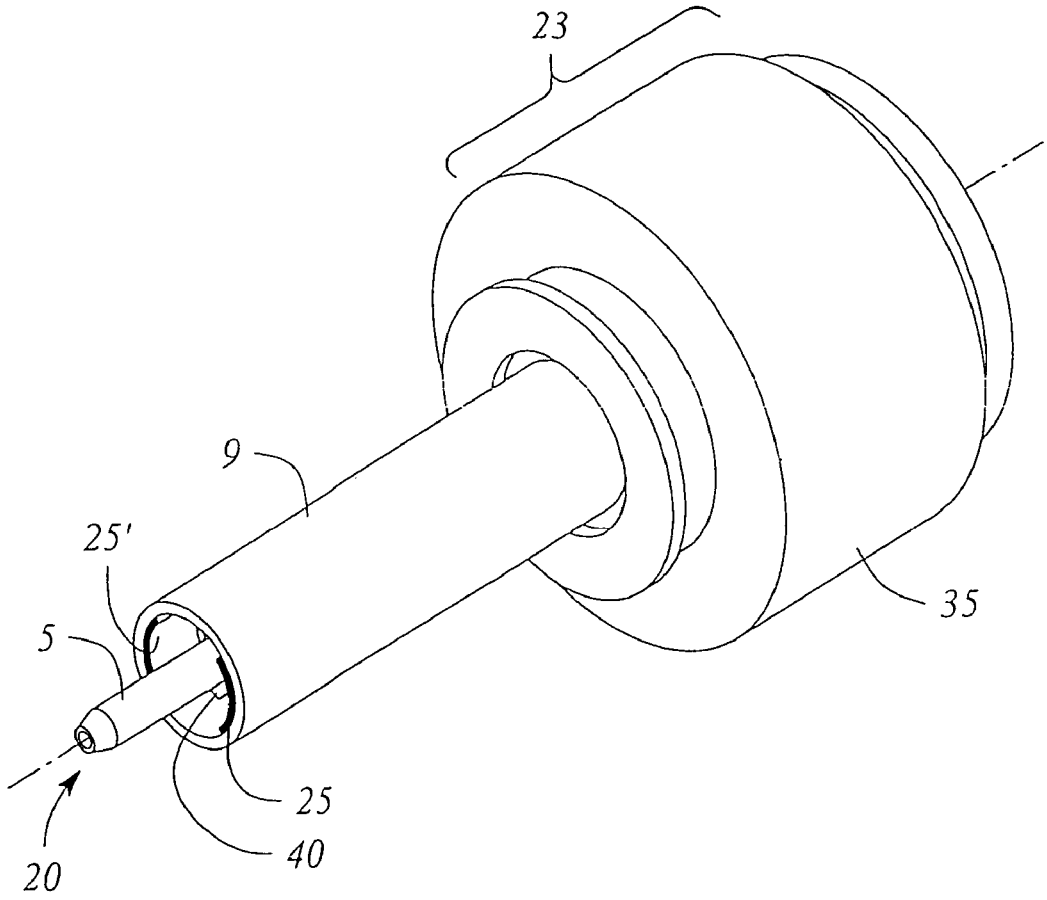
FIG. 4 shows a more detailed perspective view of the first embodiment of the present invention.
Figure 5:
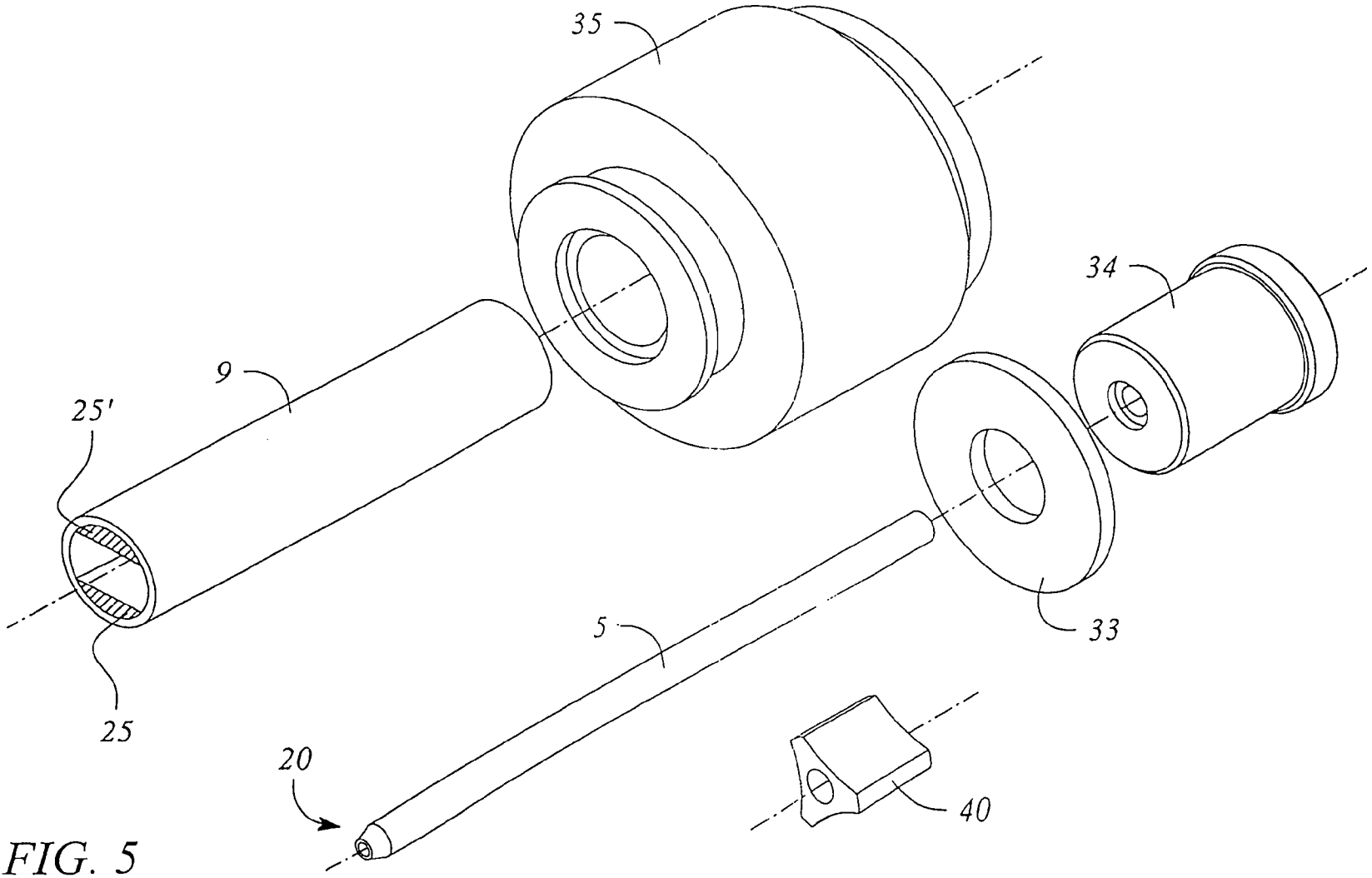
FIG. 5 shows and exploded view of the first embodiment of the present invention.
Figure 6:
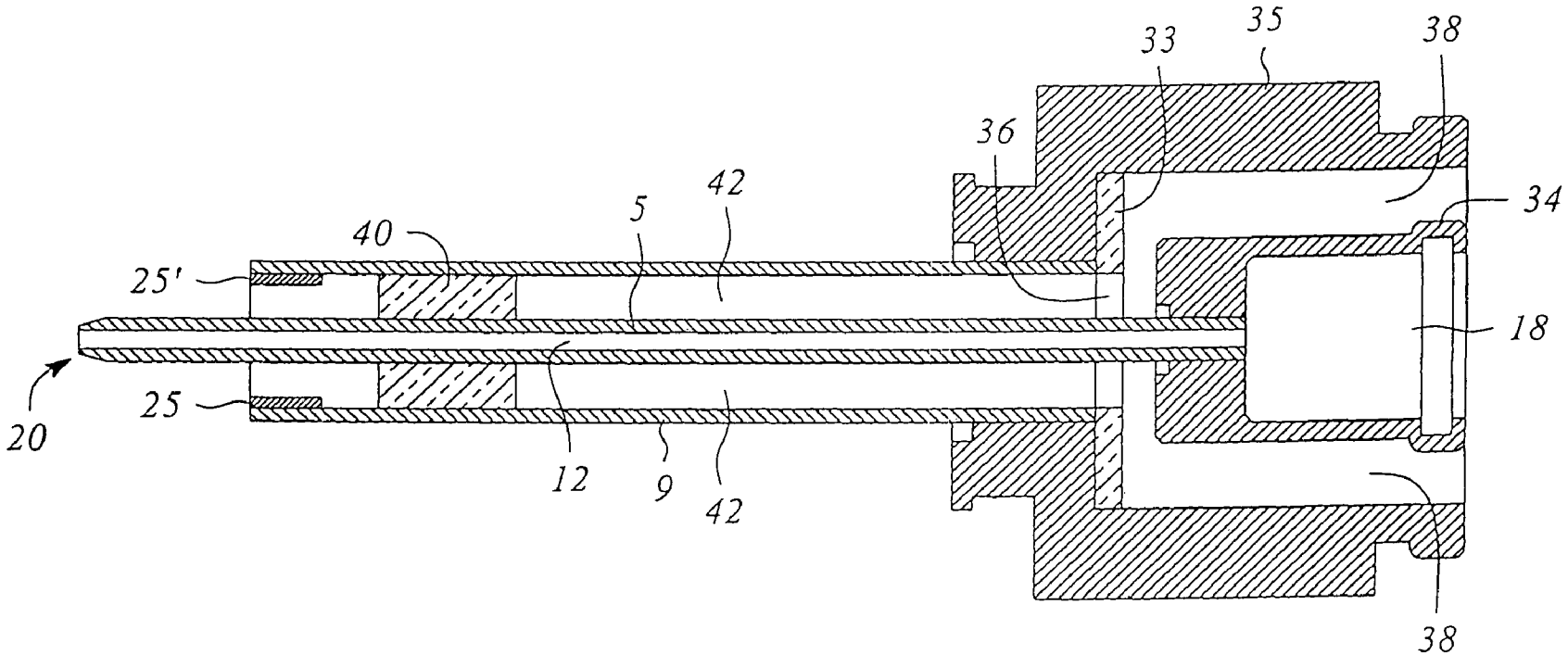
FIG. 6 shows a cross-sectional view of the first embodiment of the present invention.

FIGS. 2 and 4-7 illustrate further details of the first embodiment of the invention. The conduit 9 is designed to enclose the collecting capillary 5. The conduit 9 may enclose all of the collecting capillary 5 or a portion of it. However, it is important that the conduit 9 be adjacent to the collecting capillary end 20 so that heated gas can be delivered to the analyte ions located in the ionization region 15 before they enter or are collected by the collecting capillary 5. FIGS. 1-7, show only a few embodiments of the present invention and are employed for illustrative purposes only. They should not be interpreted as narrowing the broad scope of the invention. The conduit 9 may be a separate component or may comprise a part of the coupling 23. FIGS. 4-6 show the conduit 9 as a separate component.

FIGS. 4-6 show coupling 23 and its design for joining the collecting capillary 5, the main capillary 18, and the conduit 9. The coupling 23 is designed for attaching to a fixed support 31 (shown in FIGS. 7 and 8). The coupling 23 comprises a spacer 33, a housing 35, and a capillary cap 34 (See FIG. 5). The capillary cap 34 and the spacer 33 are designed to fit within the housing 35. The spacer 33 is designed to apply pressure to the capillary cap 34 so that a tight seal is maintained between the capillary cap 34 and the main capillary 18. The capillary cap 34 is designed to receive the main capillary 18. A small gap 36 is defined between the spacer 33 and the capillary cap 34 (See FIG. 6). The small gap 36 allows gas to flow from the gas source 7 into the collecting capillary 5 as opposed to out of the housing 35 as is accomplished with prior art devices.

An optional centering device 40 may be provided between the collecting capillary 5 and the conduit 9. The centering device 40 may comprise a variety of shapes and sizes. It is important that the centering device 40 regulate the flow of gas that is directed into the ionization region 15. The discharge electrodes 25 and/or 25' may be incorporated into or positioned adjacent to the centering device 40. FIGS. 4-6 show the centering device as a triangular plastic insert. However, other designs and devices may be employed between the conduit 9 and the collecting capillary 5.

Referring now to FIGS. 1-8, the detector 11 is located downstream from the ion source 3 and the conduit 9. The detector 11 may be a mass analyzer or other similar device well known in the art for detecting the enhanced analyte ions that were collected by the collecting capillary 5 and transported to the main capillary 18. The detector 11 may also comprise any computer hardware and software that are well known in the art and which may help in detecting enhanced analyte ions.

Having described the invention and components in some detail, a description of how the invention operates is in order.

FIG. 7 shows a cross sectional view of the first embodiment of the present invention with the conduit 9 positioned between the ion source 3 and the gas source 7. The conduit 9 operates to carry the heated gas from the gas source 7 to the collecting capillary end 20. The method of the present invention comprises producing sample ions using an ionization device, applying a heated gas to the sample ions, introducing a calibrant into the heated gas; and ionizing the calibrant using one or more discharge electrodes 25 and/or 25' to generate calibration ions. In certain instances the method may be as broad as simply introducing the calibrant into a heated gas and ionizing the calibrant using a discharge electrode.

Figure 7B:
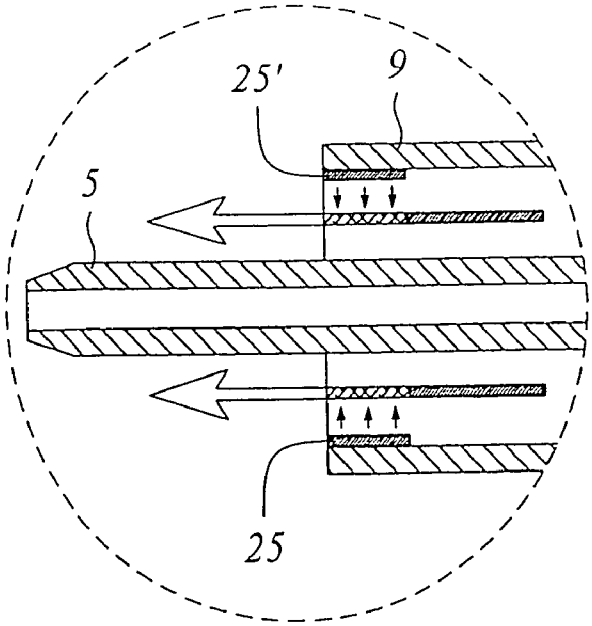

Referring to FIG. 7A and 7B, gas is produced by the gas source 7, and directed through the channels 38 and the small gap 36. From there the gas is carried into an annular space 42 defined between the conduit 9 and the collecting capillary 5. The heated gas then contacts the optional centering device 40 (not shown in FIG. 7). The centering device 40 is disposed between the collecting capillary 5 and the conduit 9 and shaped or designed in a way to regulate the flow of gas to the ionization region 15. As shown in FIG. 7B the final stage of the method comprising the ionization of the calibrant ions in the heated has by the electrodes 25 and/or 25'. After the calibrant ions are ionized in the heated gas, the heated gaas flows out of the conduit 9 into the ionization region 15 adjacent to the collecting capillary end 20. The analyte ions in the ionization region 15 are heated by the gas that is directed into this region. Analyte ions that are then enhanced are collected by the collecting capillary 5, carried to the main capillary 18 and then sent to the detector 11. It should be noted that after heat has been added to the analyte ions adjacent to the source, the detection limits and signal quality improve dramatically. This result is quite unexpected. For instance, since no solvent is used with AP-MALDI and MALDI ion sources and mass spectrometers, desolvation and/or application of a gas would not be expected to be effective in enhancing ion detection in matrix based ion sources and mass spectrometers. However, it is believed that the invention operates by the fact that large ion clusters are broken down to produce bare analyte ions that are more easily detectable. In addition, the application of heat also helps with sample evaporation.

It is to be understood that while the invention has been described in conjunction with the specific embodiments thereof, that the foregoing description as well as the examples that follow are intended to illustrate and not limit the scope of the invention. Other aspects, advantages and modifications within the scope of the invention will be apparent to those skilled in the art to which the invention pertains.

All patents, patent applications, and publications infra and supra mentioned herein are hereby incorporated by reference in their entireties.

EXAMPLE 1

A Bruker Esquire-LC ion trap mass spectrometer was used for AP-MALDI studies. The mass spectrometer ion optics were modified (one skimmer, dual octapole guide with partitioning) and the ion sampling inlet of the instrument consisted of an ion sampling capillary extension with a conduit concentric to a capillary extension. The ion sampling inlet received a gas flow of 4-10 L/min. of heated nitrogen. A laser beam (337.1 nm, at 10 Hz) was delivered by a 400 micron fiber through a single focusing lens onto the target. The laser power was estimated to be around 50 to 70 uJ. The data was obtained by using Ion Charge Control by setting the maximum trapping time to 300 ms (3 laser shots) for the mass spectrometer scan spectrum. Each spectrum was an average of 8 micro scans for 400 to 2200 AMU. The matrix used was an 8 mM alpha-cyano-4-hydroxy-cinnamic acid in 25% methanol, 12% TPA, 67% water with 1% acetic acid. Matrix targets were premixed and 0.5 ul of the matrix/target mixture was applied onto a gold plated stainless steel target.

FIG. 8A shows the results with the discharge electrode 25 inserted into the insulator 17. The needle is at ground. The extension voltage of the cap (Vcap) is at −2000 V. Note that the spectrum shows a variety of possible present contaminants. The dynamic range is from 207.1 to 573.5 m/z.

EXAMPLE 2

FIG. 8B shows the same targets were prepared and used as described above except that the needle was maintained at −2.9 KV and the extension cap (Vcap) was maintained at −1.4 KV. Note that only the spectrum of m/z ration components are present. This probably indicates the presence of less contaminating or confounding ion species.

We claim:

1. An ion source, comprising:

(a) an ionization device for producing ions in an ionization region using matrix assisted laser desorption ionization;

(b) a collecting conduit downstream from the ionization device for collecting ions;

(c) a conduit for introducing calibrants and heated gas into the ionization region; and (d) a discharge electrode in addition to said ionization device, wherein said discharge electrode is adjacent to the conduit and ionizes said calibrants within the heated gas.

2. An ion source as recited in claim 1, wherein the ionization device produces said ions by atmospheric pressure matrix assisted laser desorption ionization (AP-MALDI).

3. A mass spectrometry system comprising:

(a) an ion source, comprising:

(i) a matrix assisted laser desorption ionization device for producing ions in an ionization region;

(ii) a collecting conduit downstream from the ionization device for collecting ions;

(iii) a conduit for introducing calibrants and heated gas into the ionization region; and (iv) a discharge electrode in addition to said matrix assisted laser desorption ionization device, wherein said discharge electrode is adjacent to the conduit and ionizes said calibrants within the heated gas; and (b) a detector downstream from the ion source for detecting ions.

4. A mass spectrometry system as recited in claim 3, wherein the ionization device produces ions by atmospheric pressure matrix assisted laser desorption ionization (AP-MALDI).

5. A mass spectrometry system as recited in claim 3, wherein the detector comprises a time of flight detector (TOF).

6. A mass spectrometry system as recited in claim 3, wherein the detector comprises a quick time of flight detector (Q-TOF).

7. A method of generating calibration ions for an ion source, comprising:

(a) producing sample ions using a matrix assisted laser desorption ionization device, (b) applying a heated gas to the sample ions;

(c) introducing a calibrant into the heated gas; and (d) ionizing the calibrant using an electrode that is separate to said matrix assisted laser desorption ionization device to generate calibration ions.

8. A method of generating calibration ions in a heated gas for introduction into sample ions, comprising:

(a) providing a calibrant in a heated gas;

(b) ionizing the calibrant in the heated gas using an electrode that is separate to a matrix assisted laser desorption ionization device for producing said sample ions to generate calibration ions; and (c) introducing the calibration ions and heated gas into the sample ions.

9. The ion source of claim 1, wherein said discharge electrode is a glow discharge electrode.

* * * * *